US007988502B2

(12) United States Patent
Nagano et al.

(10) Patent No.: US 7,988,502 B2
(45) Date of Patent: Aug. 2, 2011

(54) CONNECTOR

(75) Inventors: Masao Nagano, Makinohara (JP); Shogo Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/560,299

(22) Filed: Sep. 15, 2009

(65) Prior Publication Data

US 2010/0068911 A1 Mar. 18, 2010

(30) Foreign Application Priority Data

Sep. 16, 2008 (JP) ..... 2008-237160

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS

| | | | | |
|---|---|---|---|---|
| 6,261,133 | B1 | 7/2001 | Kubo et al. | |
| 2002/0123257 | A1 | 9/2002 | Matsuoka | |
| 2002/0127913 | A1 | 9/2002 | Ichio | |
| 2002/0173198 | A1 * | 11/2002 | Plate | 439/489 |
| 2003/0068930 | A1 * | 4/2003 | Endo | 439/752 |
| 2003/0087563 | A1 * | 5/2003 | Endo | 439/752 |
| 2004/0132351 | A1 * | 7/2004 | Miyakawa et al. | 439/752 |
| 2006/0281373 | A1 * | 12/2006 | Anbo et al. | 439/752 |

FOREIGN PATENT DOCUMENTS

| | | |
|---|---|---|
| JP | 2000-252000 | 9/2000 |
| JP | 2002-329548 | 11/2002 |

* cited by examiner

*Primary Examiner* — Hien Vu

(74) *Attorney, Agent, or Firm* — Finnegan, Henderson, Farbow, Garrett & Dunner L.L.P.

(57) ABSTRACT

According to the invention, the lance for primarily retaining the terminal is formed integrally on the retainer for secondarily retaining the terminal. Therefore, there is no need to form the lance on the connector housing, and therefore the structure of the connector housing can be simplified, and the moldability of the resin-made connector housing can be enhanced.

3 Claims, 14 Drawing Sheets

CONNECTOR

BACKGROUND OF THE INVENTION

1. Field of the Invention

This invention relates to a connector in which terminals received respectively in terminal receiving chambers of a connector housing are retained against withdrawal by a retainer attached to the connector housing.

2. Description of the Related Art

In an ordinary connector, a terminal withdrawal prevention lance is formed within each terminal receiving chamber of a connector housing. When a terminal is inserted into the terminal receiving chamber of the connector housing (having such lances) from the rear side, first, the lance, while elastically deformed or bent, allows the insertion of the terminal, and when the terminal is further inserted into a predetermined position, the lance is restored from the elastically-deformed condition to become engaged with an engagement portion of the terminal, thereby preventing rearward movement of the terminal.

Also, it is a common practice to retain the terminal in a double manner against rearward movement by a retainer inserted into the connector housing from a side portion thereof.

In the case of forming the lances within the respective terminal receiving chambers, the molding of the lances is relatively difficult, and therefore there is known a connector of the type in which a front holder defining front ends of the terminal receiving chambers is attached to a connector housing, and the positions of the front ends of the terminals are determined by this front holder.

FIGS. 12 and 13 show a conventional connector disclosed, for example, in Patent Literature 1. FIG. 12 is a cross-sectional view showing a condition in which a retainer is held in a provisionally-retaining position, and FIG. 13 is a cross-sectional view showing an assembly-completed condition in which the retainer is moved into a completely-retaining position.

In this conventional connector, the retainer 120 and a front holder 130 having mating male terminal-receiving holes 132 are attached to a connector housing 100 having terminal receiving chambers 102. For assembling this connector, first, the front holder 130 is attached to a front end portion of a main portion 101 of the connector housing 100 having the terminal receiving chambers 102, and the retainer 120 is inserted into the main portion 101 of the connector housing 100 from a side portion of the connector housing 100, and is held in the provisionally-retaining position.

Then, in this condition, a terminal 150 is inserted into the terminal receiving chamber 102 from the rear side. As a result, a lance 103 formed within the terminal receiving chamber 102 is pressed and elastically deformed by the front end of the terminal 150, and when the terminal 150 is further inserted into a predetermined position, the lance 103 is restored from the elastically-deformed condition to become engaged with the terminal 150, thereby preventing the terminal 150 from rearward withdrawal.

Then, in this condition, the retainer 120 is moved into the completely-retaining position as shown in FIG. 13. As a result, an engagement portion 122 of the retainer 120 is engaged with a constricted portion, etc., of the terminal 150, thereby retaining the terminal 150 in a double manner against rearward movement.

FIG. 14 is a cross-sectional view of another conventional connector disclosed, for example, in Patent Literature 2 as seen from the front side.

In this conventional connector, terminal receiving chambers 202 are formed in a pillar-like main portion 201 of a connector housing 200, and a retainer 220 of a generally U-shaped cross-section is adapted to be fitted on the outer periphery of the pillar-like main portion 201. When the retainer 220 is held in a provisionally-retaining position, opening portions 222 of the retainer 220 are aligned respectively with the terminal receiving chambers 202, and therefore the retainer 220 allows the insertion of the terminals. When the retainer 220 is moved into the completely-retaining position, a retaining wall 221 of the retainer 220 intrudes into the terminal receiving chambers 202, and are engaged with the terminals, thereby preventing the withdrawal of the terminals.

Patent Literature 1: JP-A-2002-329548

Patent Literature 2: JP-A-2000-252000

In the conventional connectors, the retainer is provided only with the secondary terminal-retaining function, and in the case of providing the lances for primarily-retaining purposes, it is common to form these lances on the connector housing. However, these lances are formed within the respective terminal receiving chambers, and therefore in the case where the terminal receiving chambers have only small holes formed in their respective front ends, and therefore are almost closed at their front ends by the respective front walls, it is very difficult to mold these lances.

Therefore, in many cases, the front walls of the terminal receiving chambers have been formed or defined by the front holder 130 separate from the connector housing as in the conventional example of FIGS. 12 and 13 so that the lances 103 can be easily molded integrally on the connector housing 100.

However, when the front holder 130 is provided, there are encountered problems that the number of the component parts increases and that the time and labor for assembling the connector increase.

Furthermore, when the lances 103 are formed integrally on the connector housing 100, a resin material of an increased strength such as a glass-containing resin material can not be used for forming the connector housing since the lances need to have elasticity. As a result, there is encountered a problem that under high temperatures, the resin becomes soft, so that the connector will be affected by vibration.

SUMMARY OF THE INVENTION

In view of the above circumstances, it is an object of this invention to provide a connector in which the number of component parts is kept to a minimum, and a molding operation can be easily effected, and an originally-intended function of the connector can be fully achieved, and besides a high-strength material such as a glass-containing resin can be used for forming a connector housing.

A first aspect of the invention provides a connector comprising:

a connector housing having a terminal receiving chamber into which a terminal is to be inserted; and a retainer which is to be inserted into the connector housing so as to extend across the terminal receiving chamber and that is movable from a provisionally-retaining position where the retainer is provisionally retained and to a completely-retaining position where the retainer is completely retained, the retainer including, an elastic lance for primarily-retaining that is provided so as to project into the interior of the terminal receiving chamber and that is pressed and elastically deformed by the terminal inserted into the terminal receiving chamber so as to allow the insertion of the terminal and then is restored from elastically-deformed condition to become engaged with the terminal when the terminal is inserted into a predetermined position;

a secondary retaining portion that allows the insertion of the terminal into the terminal receiving chamber when the retainer is disposed in the provisionally-retaining position, and that is engaged with the terminal when the retainer is disposed in the completely-retaining position;

wherein the secondary retaining portion and the lance are formed integrally on the retainer, and at least when the retainer is disposed in the provisionally-retaining position, the lance projects into the interior of the terminal receiving chamber.

A second aspect of the invention provides the connector according to the first aspect of the invention, wherein the retainer includes the secondary retaining portion, the lance, a cantilever-like insertion piece portion for insertion into the interior of the connector housing, and a pair of arms extending from a proximal end portion of the insertion piece portion and further extending in generally parallel spaced relation respectively to upper and lower sides of the insertion piece portion, and the pair of arms can slide on an outer surface of the connector housing so as to hold the retainer selectively in the provisionally-retaining position and the completely-retaining position, and each of the pair of arms is divided into a first arm and a second arm, and the first arm includes a retaining portion for retaining the retainer in the provisionally-retaining position and the completely-retaining position, and can be elastically deformed when the retainer is to be retained on the connector housing, and the second arm includes a generally L-shaped guide rib for fitting in a guide groove in the outer surface of the connector housing so as to slide in the direction of insertion of the retainer, and the retainer is prevented from disengagement from the connector housing by the L-shaped guide rib fitted in the guide groove.

A third aspect of the invention provides the connector according to the first aspect of the invention, wherein the connector housing includes a pillar-like main portion which has the terminal receiving chamber and has an outer periphery on which a fitting peripheral wall of a mating connector can be fitted, and a hood portion which covers the outer periphery of the pillar-like main portion with an annular space formed therebetween so as to cover the fitting peripheral wall of the mating connector, and an annular seal member is mounted on the outer periphery of that end portion of the pillar-like main portion disposed at a rear side in the connector fitting direction, and can seal a gap between the main portion and the fitting peripheral wall of the mating connector fitted on the outer periphery of the main portion, and the pair of arms of the retainer are disposed so as to prevent withdrawal of the seal member.

A fourth aspect of the invention provides the connector according to the fourth aspect of the invention, wherein the connector housing includes a plurality of the terminal receiving chambers arranged in a row in a left-right direction, and the retainer includes a plurality of the lances equal in number to the plurality of terminal receiving chambers, and a plurality of the secondary retaining portions equal in number to the plurality of terminal receiving chambers.

According to the first aspect of the invention, the lance for primarily retaining the terminal is formed integrally on the retainer for secondarily retaining the terminal. Therefore, there is no need to form the lance on the connector housing, and therefore the structure of the connector housing can be simplified, and the moldability of the resin-made connector housing can be enhanced. Furthermore, in the case where the lances were formed integrally on the connector housing, a high-strength resin material such as a glass-containing resin material could not be used for forming the connector housing since the lances need to have elasticity. In the present invention, however, the lance is separate from the connector housing, and therefore a high-strength resin material such as a glass-containing resin material can be used for forming the connector housing. With the use of such a resin material, the resin of which the connector housing is molded will not become soft under a high-temperature vibrating condition, so that the ability to hold the terminal will not be lowered, and therefore the vibration resistance of the connector can be enhanced. In the case where the lances were formed integrally on the connector housing, the front holder was often required to be attached to the front side of the terminal receiving chambers because of a molding difficulty. In the present invention, however, such a front holder does not need to be provided since the lance is formed on the retainer, and the number of the component parts can be reduced According to the second aspect of the invention, by fitting the L-shaped guide ribs of the retainer respectively in the guide grooves in the connector housing, the retainer can be positively prevented from disengagement from the connector housing, for example, during transport of the connector and during the time when the retainer is moved from the provisionally-retaining position to the completely-retaining position.

According to third aspect of the invention, by attaching the retainer to the connector housing, the seal member can be prevented from withdrawal, for example, during the transport.

According to the fourth aspect of the invention, by using the retainer to be attached to the connector housing having the plurality of terminals, the terminals can be positively held in the primarily-retained condition or the secondarily-retained condition.

DESCRIPTION OF THE PREFERRED EMBODIMENTS

A preferred embodiment of the present invention will now be described with reference to the drawings.

Figure 1:
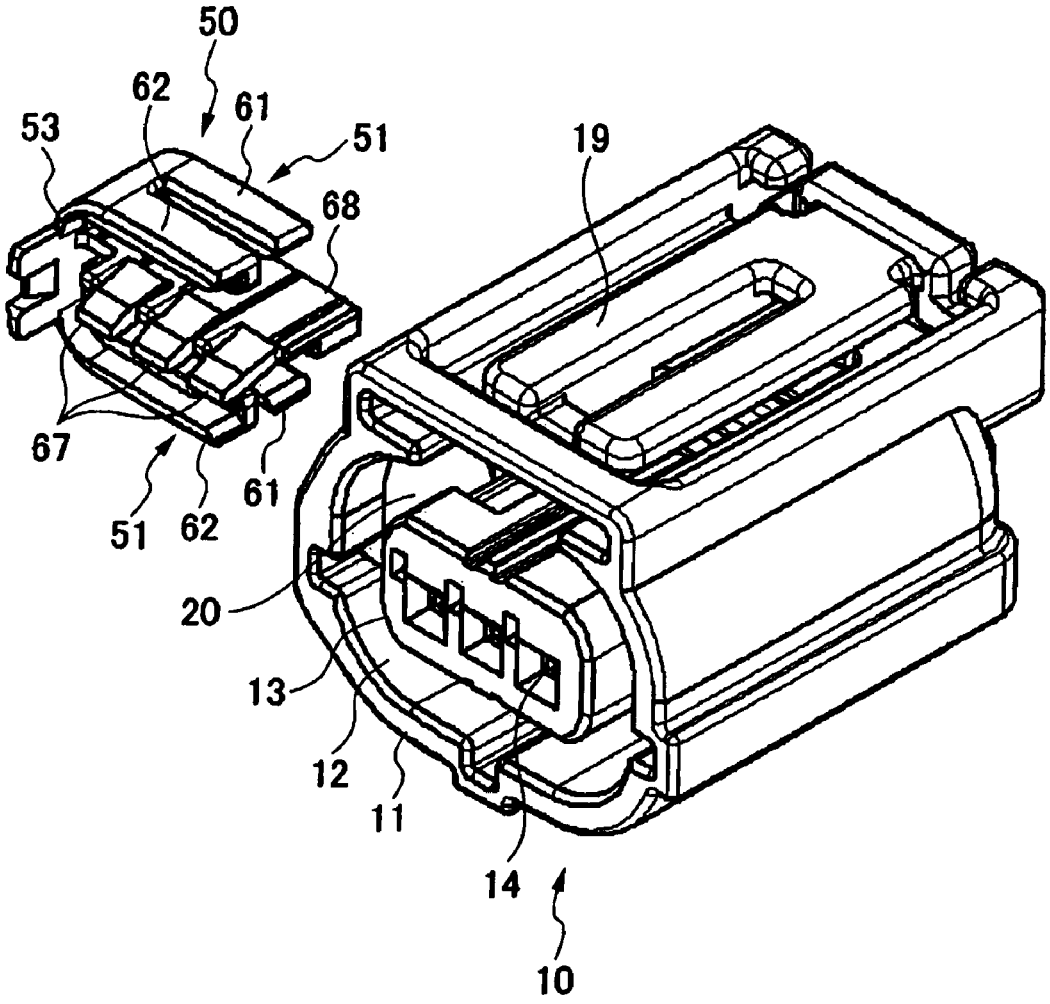
FIG. 1 is an exploded perspective view of a preferred embodiment of a connector of the present invention as seen from the front side.
Figure 2:
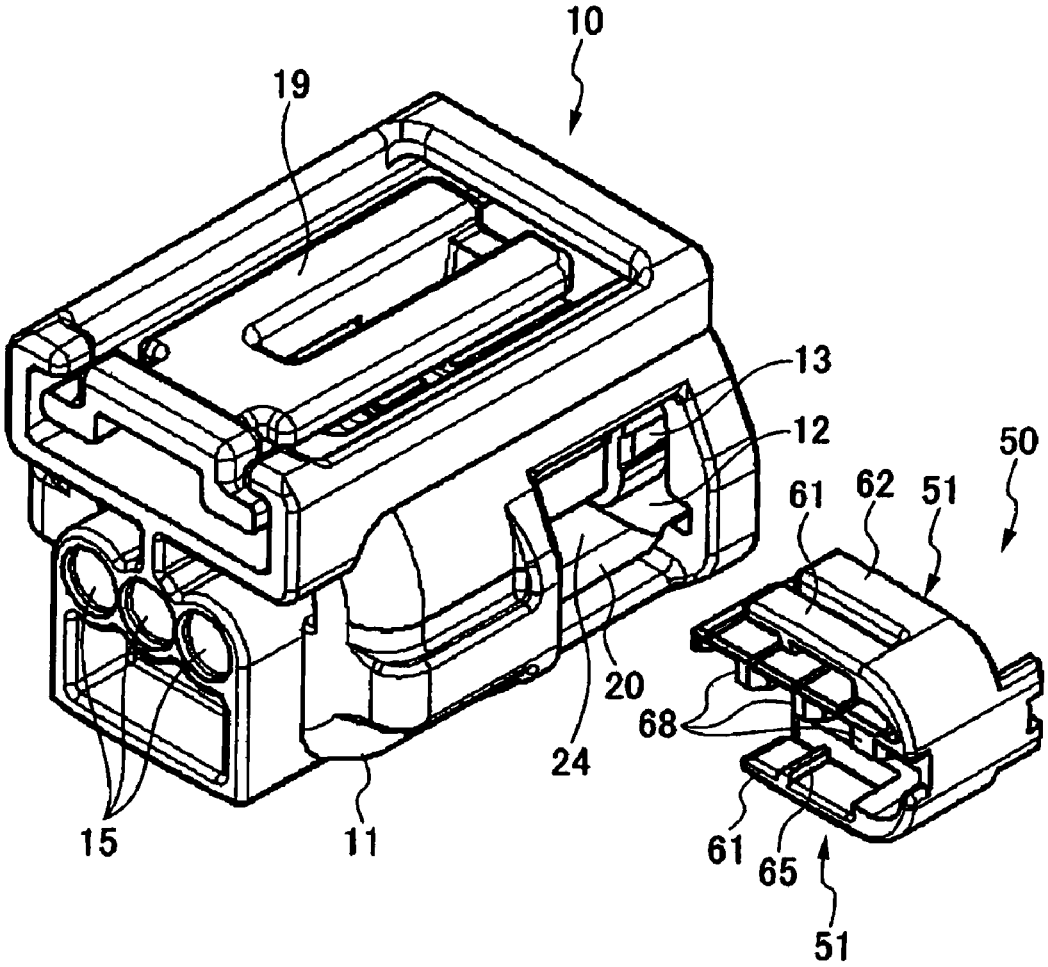
FIG. 2 is an exploded perspective view of the connector as seen from the rear side.
Figure 3:
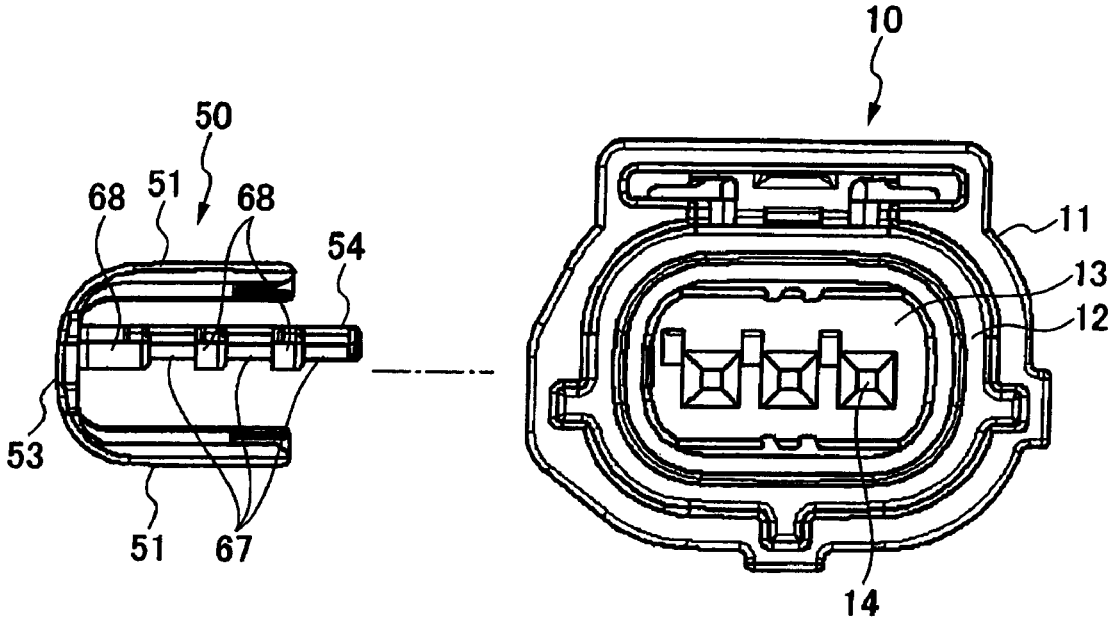
FIG. 3 is an exploded front-elevational view of the connector.
Figure 4:
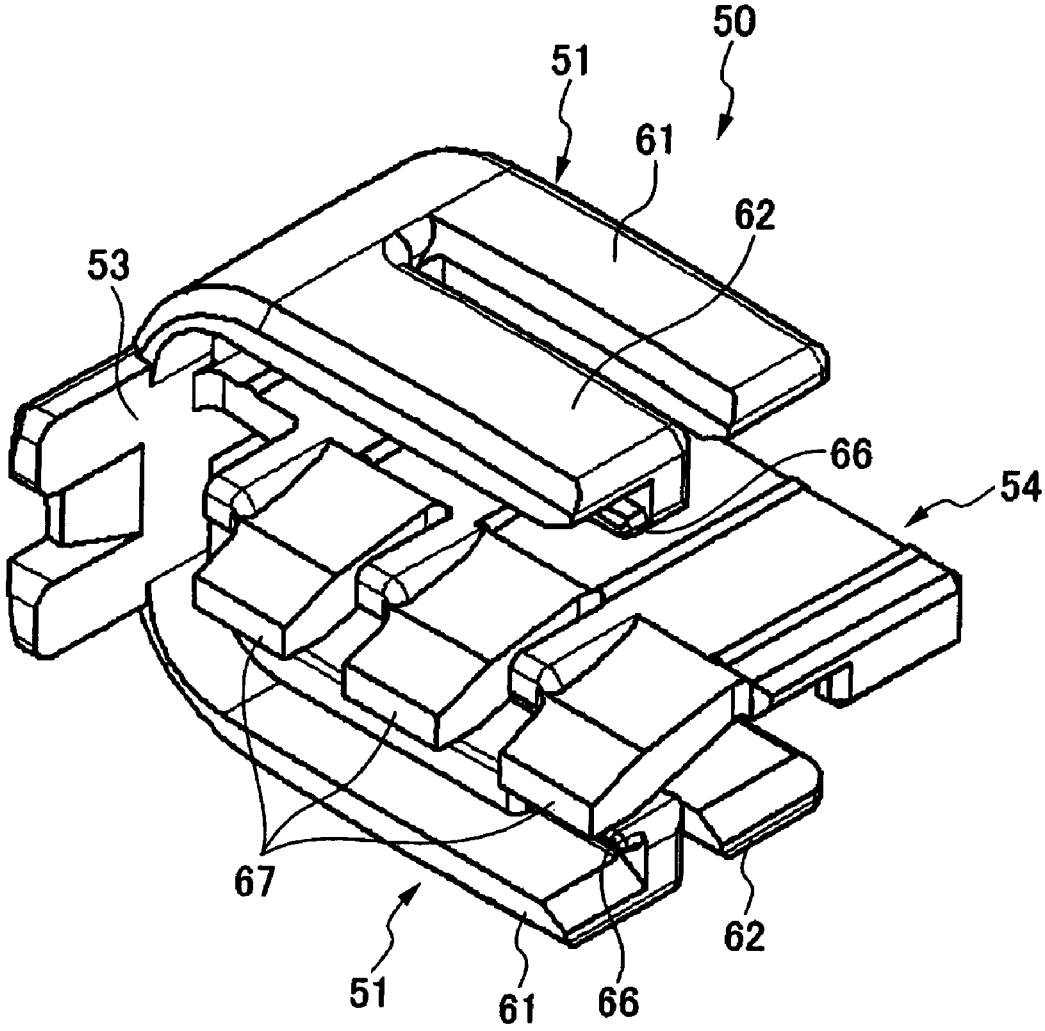
FIG. 4 is a perspective view of a retainer used in the connector of the above embodiment.
Figure 5:
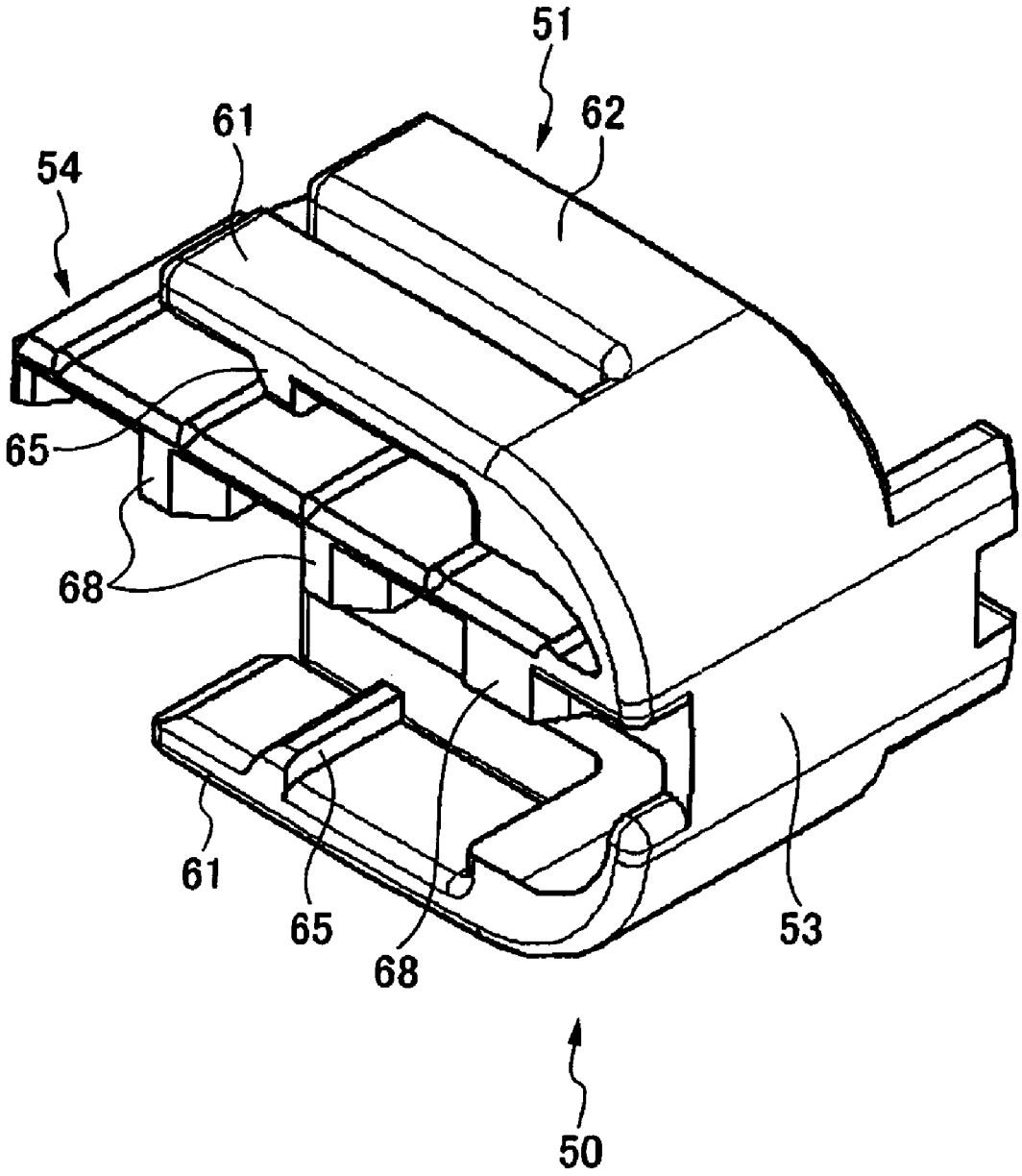
FIG. 5 is a perspective view of the retainer as seen from a direction opposite to the direction of FIG. 4.
Figure 6A:
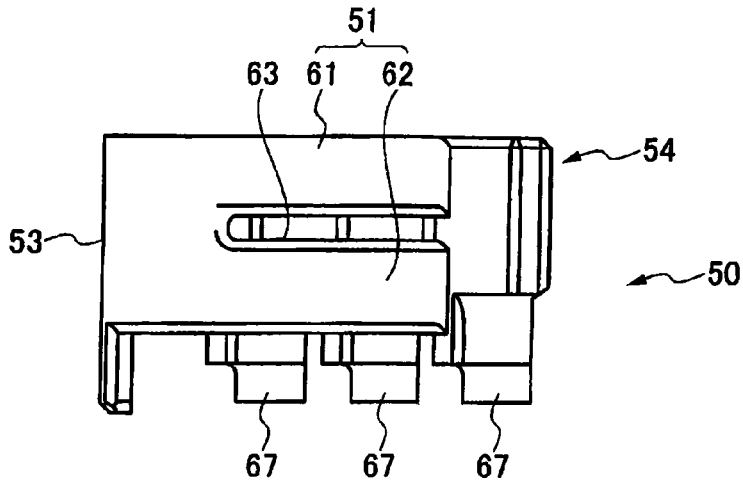
FIG. 6A is a front-elevational view of the retainer.
Figure 6B:
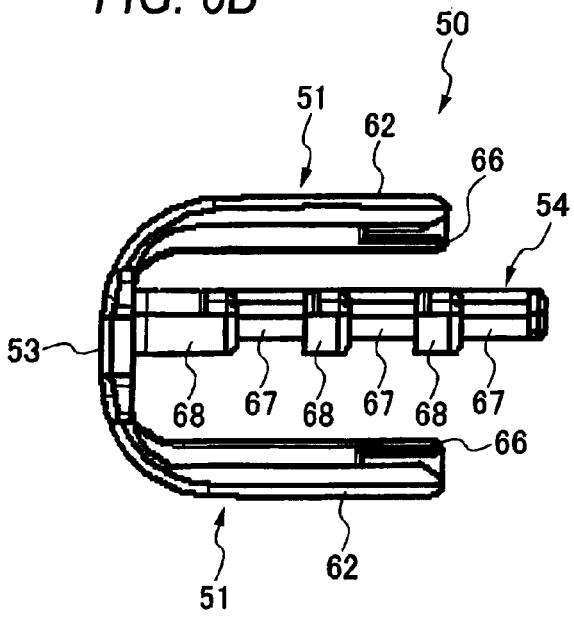
FIG. 6B is a plan view of the retainer.
Figure 6C:
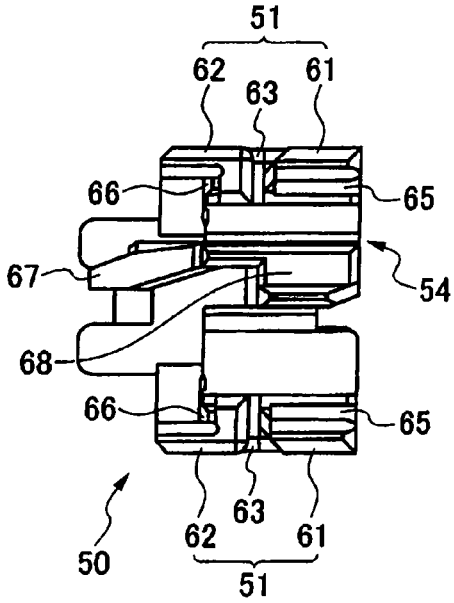
FIG. 6C is a side-elevational view of the retainer.
Figure 7:
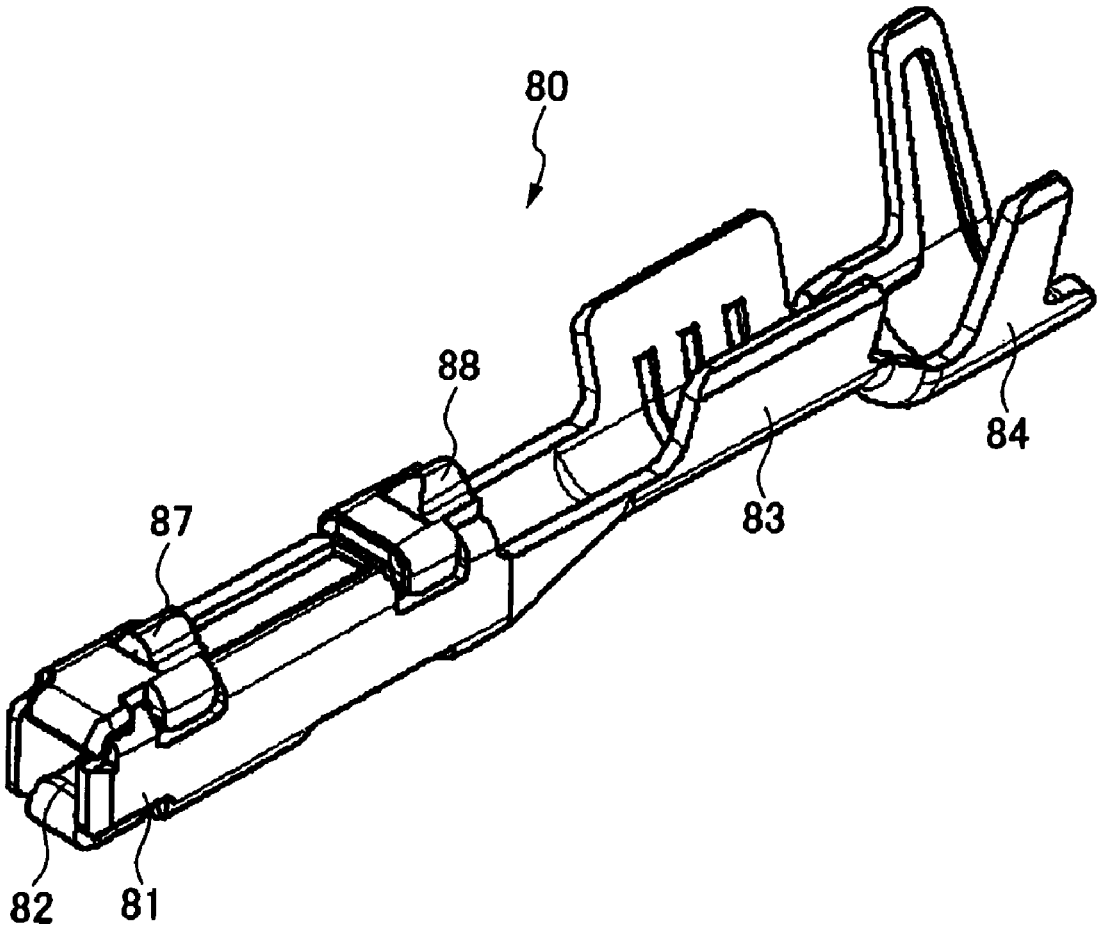
FIG. 7 is a perspective view of a terminal used in the connector of the above embodiment.
Figure 8:
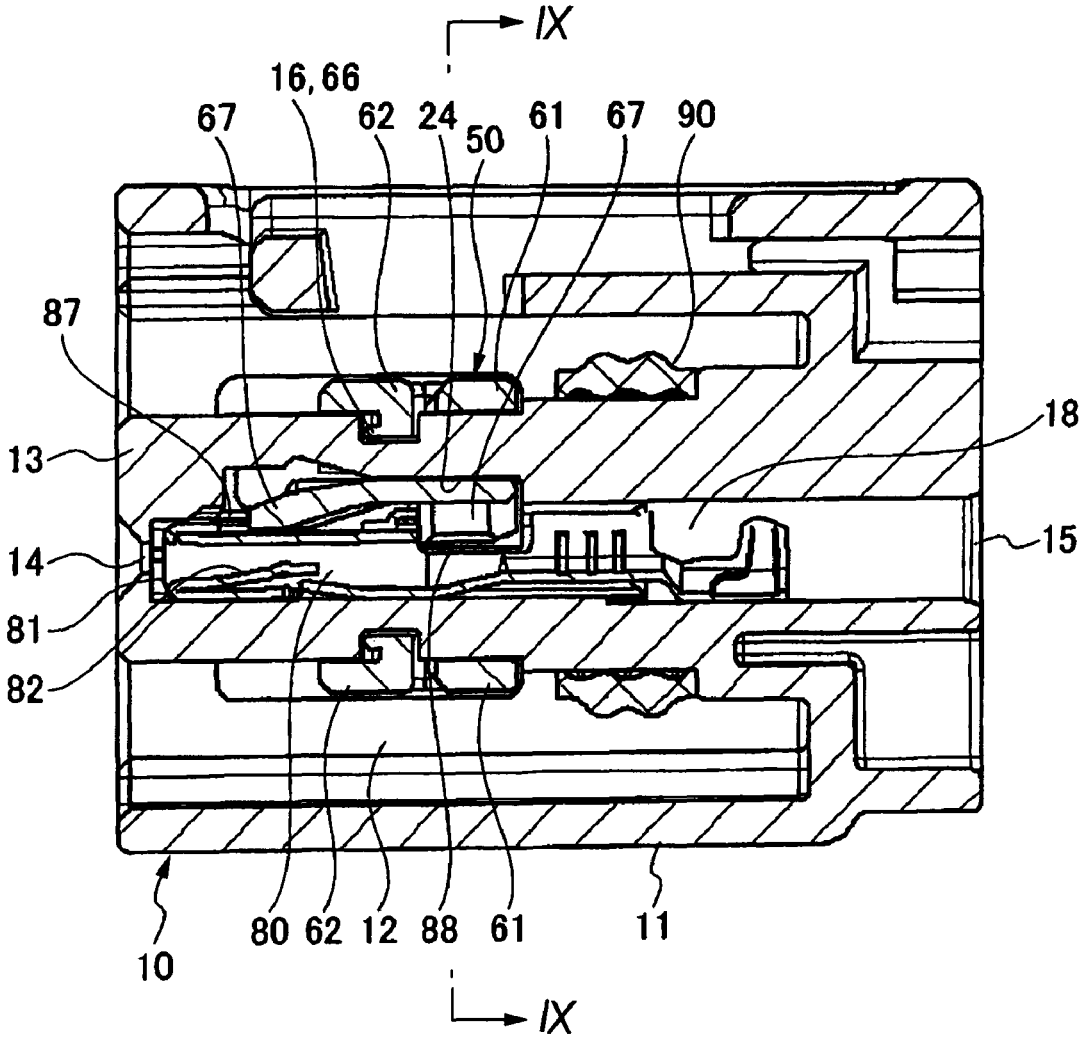
FIG. 8 is a cross-sectional view showing a condition in which the retainer is held in a provisionally-retaining position, and the terminal is inserted into a terminal receiving chamber of a connector housing from the rear side thereof, and is primarily retained by a lance.
Figure 9:
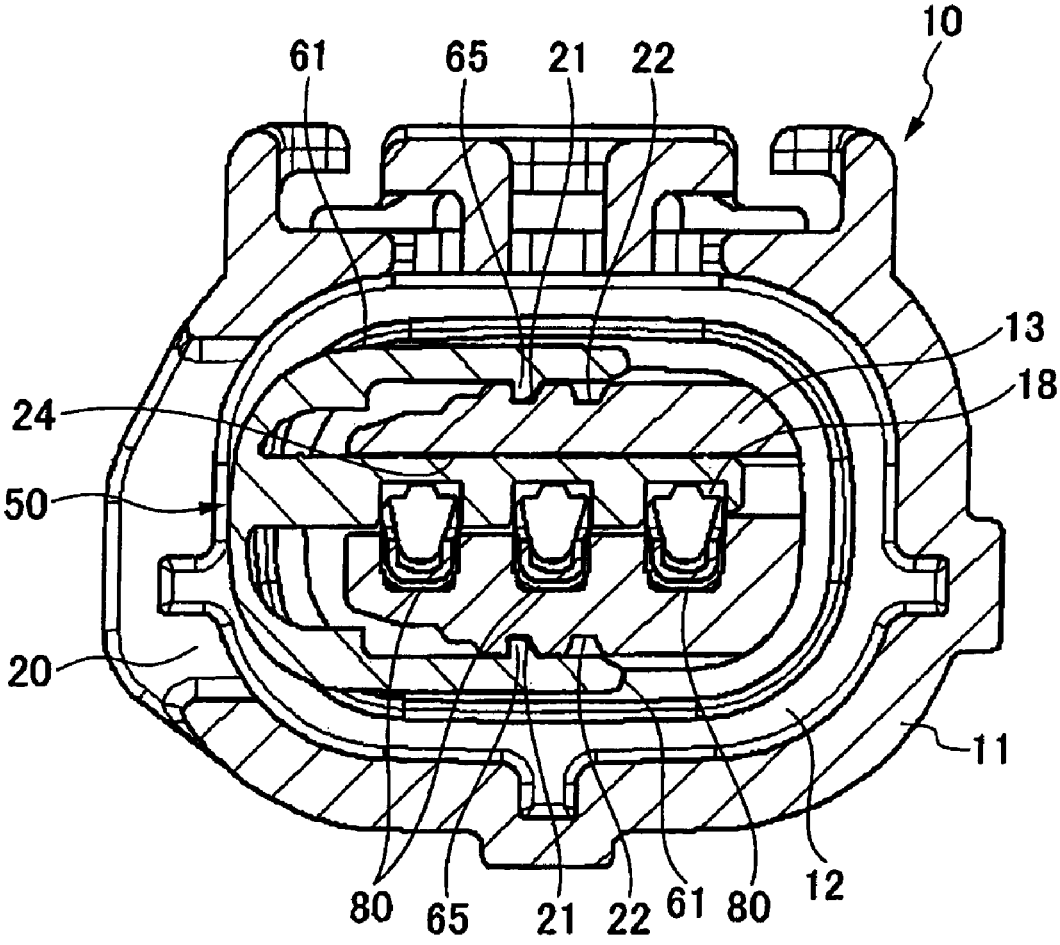
FIG. 9 is a cross-sectional view taken along the line IX-IX of FIG. 8.
Figure 10:
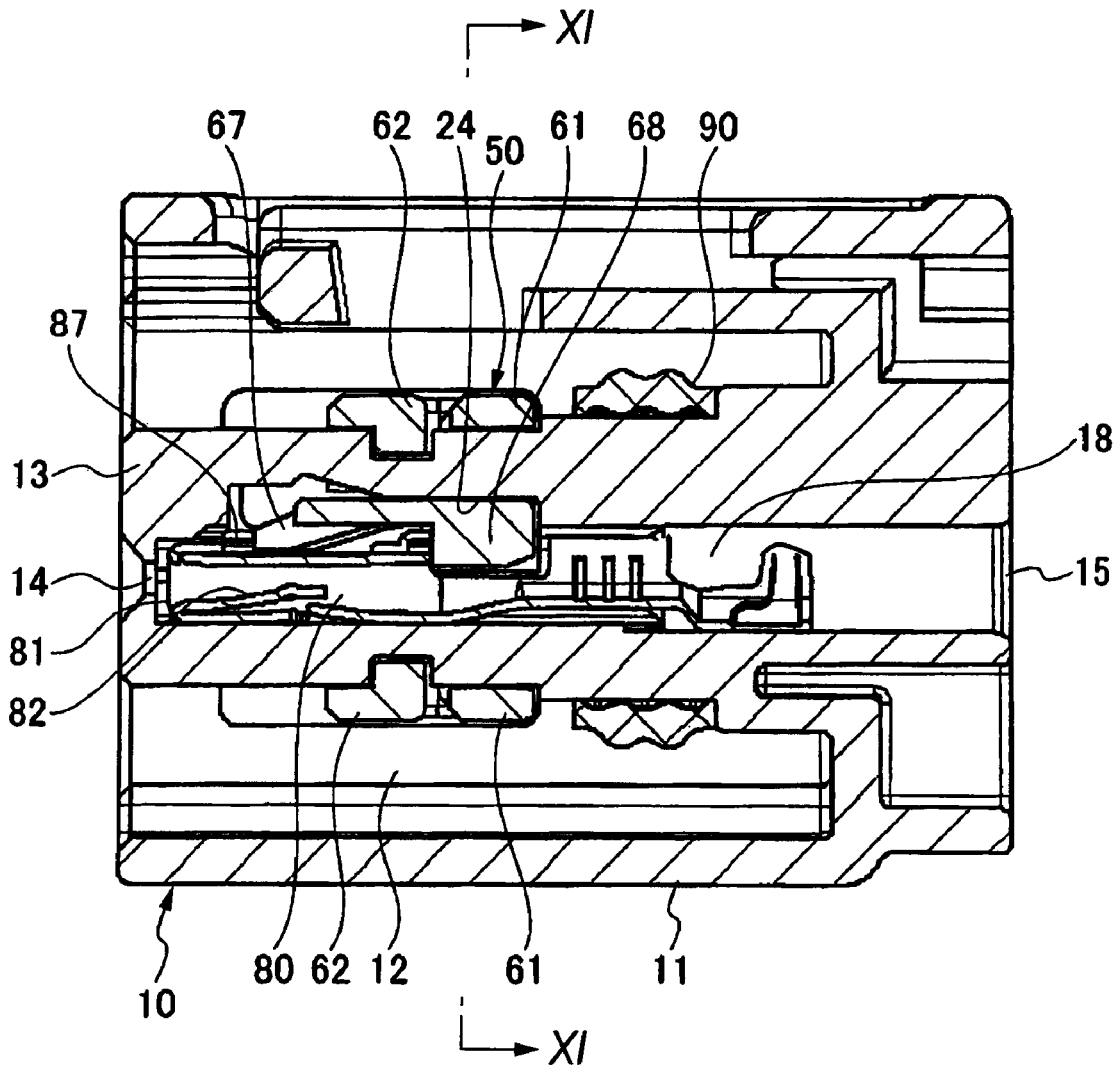
FIG. 10 is a cross-sectional view showing a condition in which the retainer is moved into a completely-retaining position, and retains the terminals by its secondary retaining portions.
Figure 11:
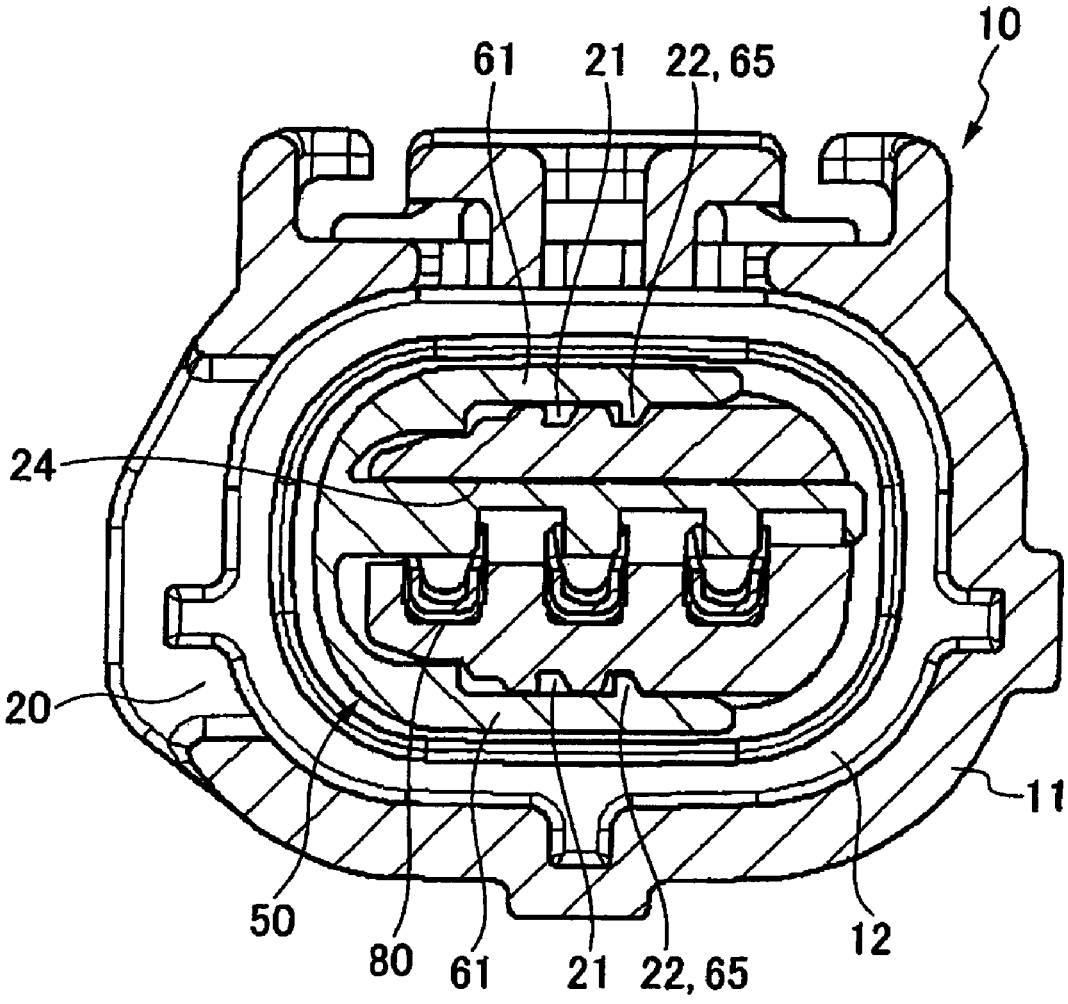
FIG. 11 is a cross-sectional view taken along the line XI-XI of FIG. 10.
Figure 12:
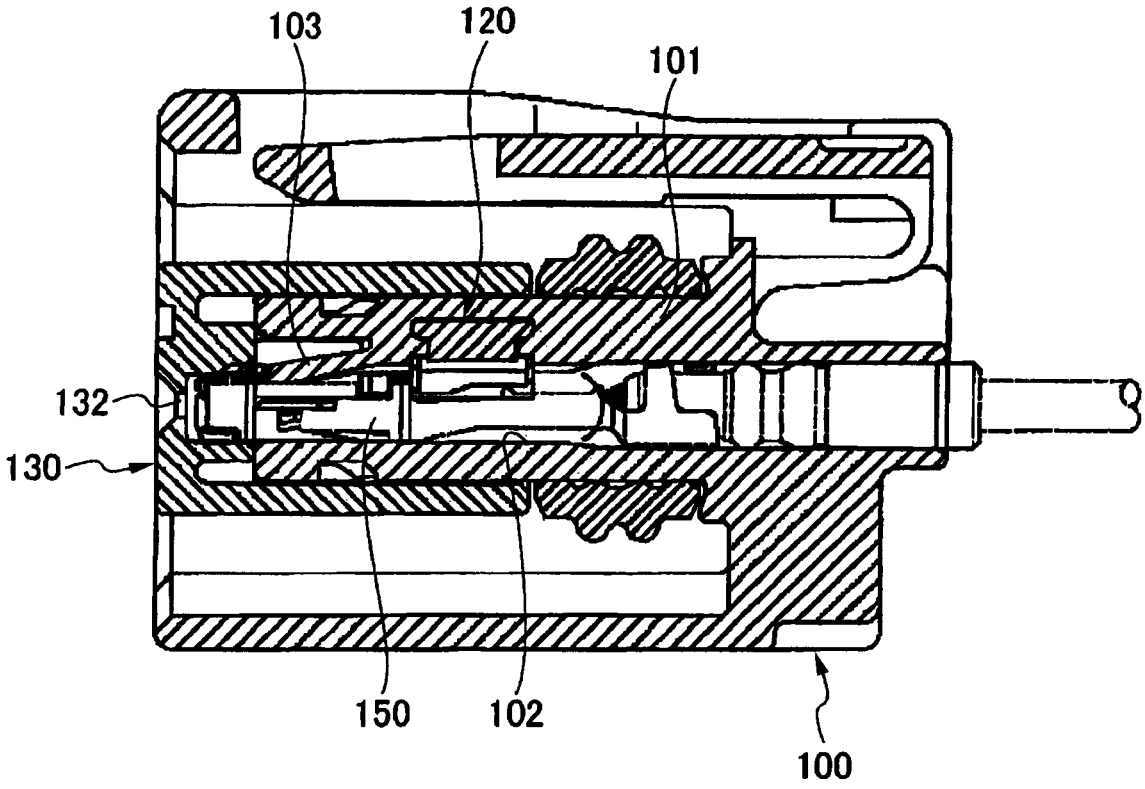
FIG. 12 is a cross-sectional view of a conventional connector, showing a condition in which a retainer is disposed in a provisionally-retaining position.
Figure 13:
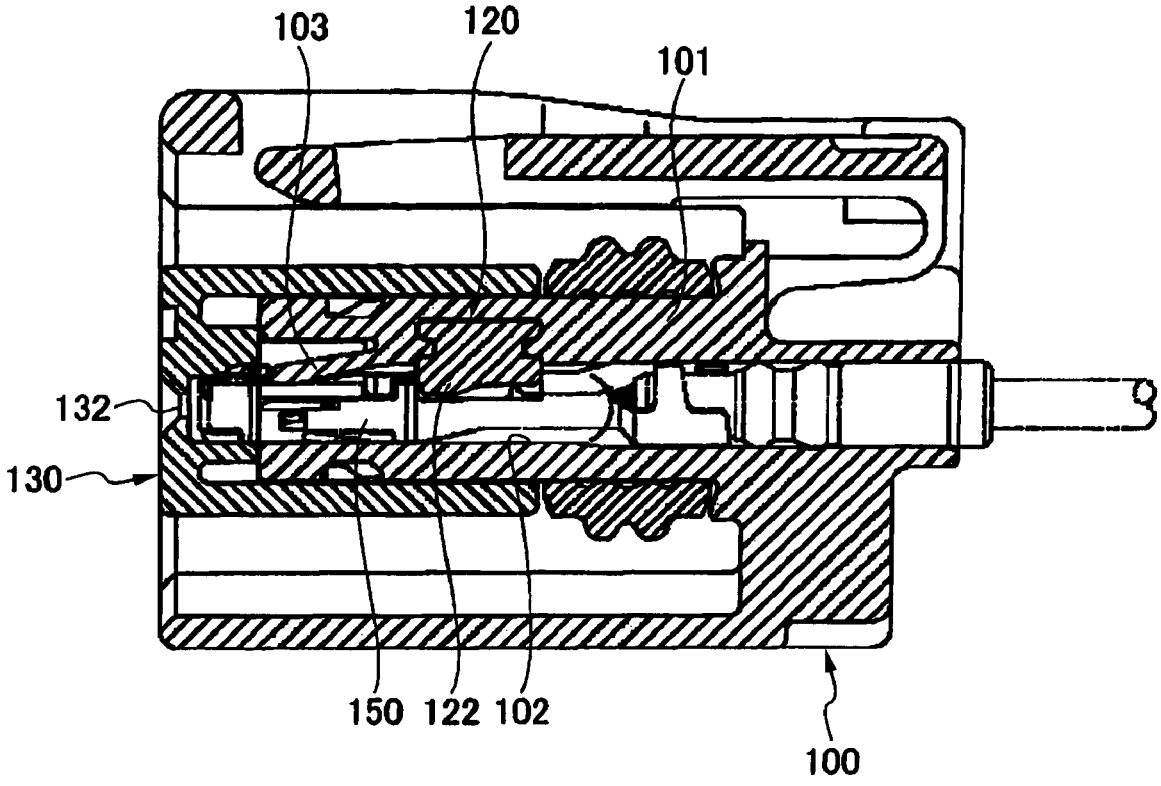
FIG. 13 is a cross-sectional view of the conventional connector, showing a condition in which the retainer is disposed in a completely-retaining position.
Figure 14:
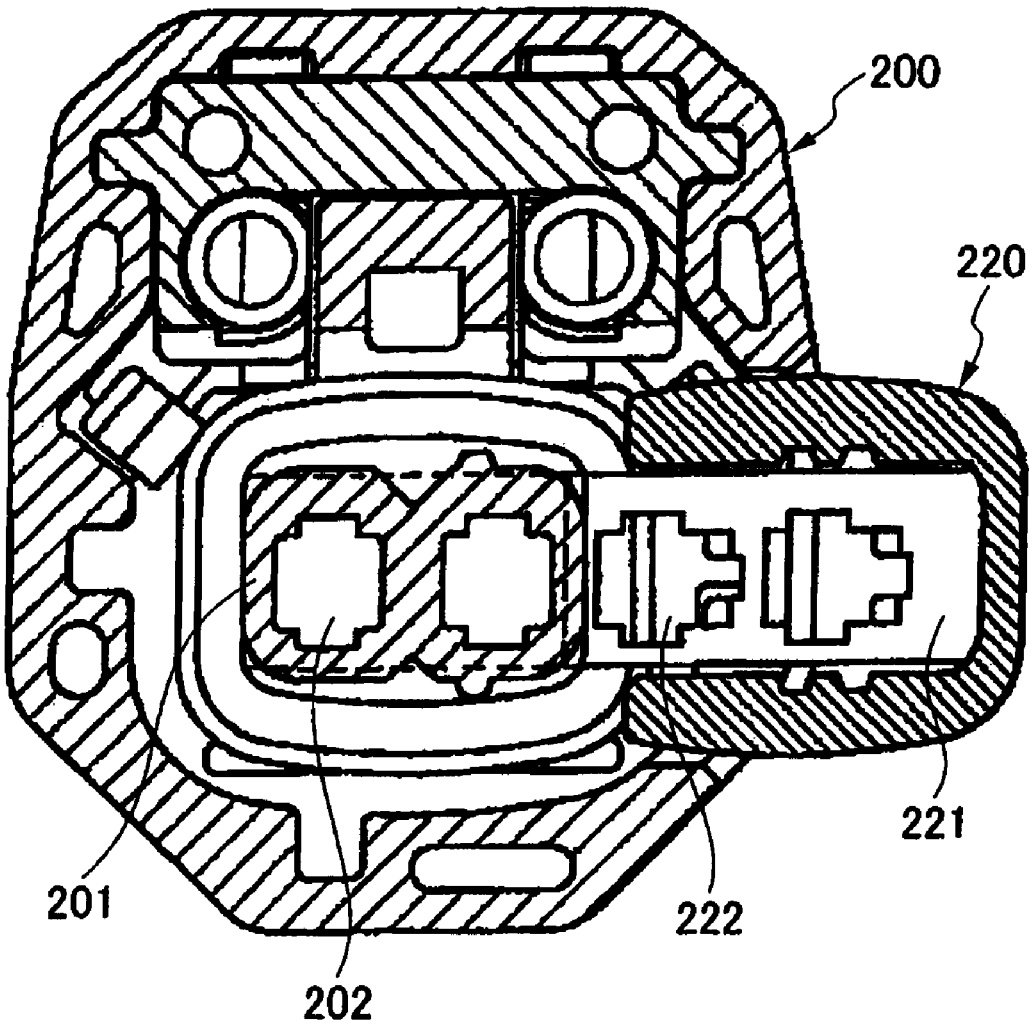
FIG. 14 is a cross-sectional view of another conventional connector as seen from the front side, showing important portions thereof.

FIG. 1 is an exploded perspective view of a connector of this embodiment as seen from the front side, FIG. 2 is an exploded perspective view of the connector of the embodiment as seen from the rear side, FIG. 3 is an exploded front-elevational view of the connector, FIG. 4 is a perspective view of a retainer used in the connector of the embodiment, FIG. 5 is a perspective view of the retainer as seen from a direction opposite to the direction of FIG. 4, FIG. 6A is a front-elevational view of the retainer, FIG. 6B is a plan view of the retainer, FIG. 6C is a side-elevational view of the retainer, FIG. 7 is a perspective view of a terminal used in the connector of the embodiment, FIG. 8 is a cross-sectional view showing a condition in which the retainer is held in a provisionally-retaining position, and the terminal is inserted into a terminal receiving chamber of a connector housing from the rear side thereof, and is primarily retained by a lance, FIG. 9 is a cross-sectional view taken along the line IX-IX of FIG. 8, FIG. 10 is a cross-sectional view showing a condition in which the retainer is moved into a completely-retaining position, and retains the terminals by its secondary retaining portions, and FIG. 11 is a cross-sectional view taken along the line XI-XI of FIG. 10.

As shown in FIGS. 1 to 3, the connector of this embodiment comprises the connector housing 10 (which is a resin-molded product), the retainer 50 (which is a resin-molded product) inserted into the connector housing 10 from a side portion thereof, female terminals 80 (each of which is a metal-pressed product) shown in FIG. 7, and an annular seal member 90 (which is a rubber-molded product) shown in FIGS. 8 and 10.

The connector housing 10 includes a hood portion 11 (which is an outermost peripheral portion), a pillar-like main portion 13 disposed within the hood portion 11, an annular space 12 formed between the hood portion 11 and the main portion 13, and a lock arm 19 formed at the upper side of the hood portion 11. The hood portion 11 and the main portion 13 are interconnected at a rear portion of the connector housing 10 as shown in FIG. 8.

The pillar-like main portion 13 has three terminal receiving chambers 18 arranged in a row in a left-right direction and extending in a forward-rearward direction. As shown in FIG. 8, each terminal receiving chamber 18 communicates at its front end with the exterior via a mating terminal insertion port 14 (which receives a distal end portion of a mating terminal therein), and is open at its rear end to provide a terminal insertion port 15.

As shown in FIG. 7, the terminal 80 for insertion into the terminal receiving chamber 80 through the terminal insertion port 15 formed at the rear end thereof includes a box-like portion 81 formed at a front portion thereof and containing a spring piece portion 82, and the terminal 80 further includes a conductor press-clamping portion 83 and a sheath press-clamping portion 84 which are formed at a rear portion thereof. A first engagement projection 87 for engagement with the lance (described later) is formed on a front portion of an upper surface of the box-like portion 81, and a second engagement projection 88 for engagement with the secondary retaining portion of the retainer 50 (described later) is formed on a rear portion of the upper surface of the box-like portion 81.

A fitting peripheral wall (not shown) of a mating connector is adapted to be fitted on the outer periphery of the pillar-like main portion 13 of the connector housing 10. The annular seal member 90 is mounted on the outer periphery of that end portion of the main portion 13 disposed at the rear side in the connecting fitting direction. When the fitting peripheral wall of the mating connector is fitted on the outer periphery of the pillar-like main portion 13, the seal member 90 seals a gap between the fitting peripheral wall of the mating connector and the main portion 13. The hood portion 11 (defining the outer peripheral portion of the connector housing) covers the outer periphery of the pillar-like main portion 13, and when the fitting peripheral wall of the mating connector is fitted on the outer periphery of the pillar-like main portion 13, the hood portion 11 covers the fitting peripheral portion of the mating connector.

As shown in FIG. 2, a retainer insertion port 20 for the insertion of the retainer 50 thereinto is formed in one side portion (left side portion in the drawings) of the hood portion 11. A retainer insertion hole 24 is formed in that side portion (left side portion) of the pillar-like main portion 13 corresponding to the retainer insertion port 20.

As shown in FIGS. 4 to 6, the retainer 50 has a one-piece or integral construction, and includes the elastic lances 67 equal in number to the terminal receiving chambers 18, and the secondary retaining portions 68 equal in number to the terminal receiving chambers 18. The retainer 50 is inserted into the interior of the connector housing 10 from the side portion thereof to extend across the terminal receiving chambers 18. The retainer 50 thus inserted in the connector housing 10 can be moved from the provisionally-retaining position where the retainer 50 is provisionally retained to the completely-retaining position where the retainer 50 is completely retained.

When the retainer 50 is located in the provisionally-retaining position as shown in FIGS. 8 and 9, the secondary retaining portions 68 do not intrude respectively into the terminal receiving chambers 18, thus allowing the terminals 80 to be inserted into the respective terminal receiving chambers 18. When the retainer 50 is located in the completely-retaining position as shown in FIGS. 10 and 11, the secondary retaining portions 68 intrude respectively into the terminal receiving chambers 18, and are engaged with the respective terminals 80, thereby preventing the terminals 80 from rearward movement.

At least when the retainer 50 is disposed in the provisionally-retaining position, the lances 67 project respectively into the interiors of the terminal receiving chambers 18, and in this condition (in which each lance 67 projects into the terminal receiving chamber 18), when each terminal 80 is inserted into the terminal receiving chamber 18 from the rear side, the lance 67 is pressed and elastically deformed by the terminal 80, thus allowing the insertion of the terminal 80. When the terminal 80 is further inserted into a predetermined position, the lance 67 is restored from the elastically-deformed condition to become engaged with the first engagement projection 87 of the terminal 80, thereby preventing the rearward movement of the terminal 80.

The construction of the retainer 50 will be described in further detail. As shown in FIGS. 4 to 6, the retainer 50 includes the secondary retaining portions 68, the lances 67, a cantilever-like insertion piece portion 54 for insertion into the retainer insertion hole 24 of the connector housing 10, a pair of arms 51 and 51 extending from a proximal end portion of the insertion piece portion 54 and further extending in generally parallel spaced relation respectively to the upper and lower sides (or surfaces) of the insertion piece portion 54, and an interconnecting portion 53 interconnecting the arms 51 and 51 and the insertion piece portion 54. The pair of arms 51 and 51 can slide on the outer surface of the main portion 13 of the connector housing 10 so as to hold the retainer 50 selectively in the provisionally-retaining position and the completely-retaining position.

Each of the pair of arms 51 and 51 is divided into a first arm 61 and a second arm 62 by a slit 63 formed in a widthwise-central portion thereof. The first arm 61 can be elastically deformed or bent when the retainer 50 is to be provisionally or completely retained on the connector housing 10. The first arm 61 has one retaining projection (retaining portion) 65 formed on an inner surface thereof, and the retaining projection 65 of each first arm 61 can be engaged selectively in a provisionally-retaining recess 21 and a completely-retaining recess 22 (which are formed in the outer periphery of the main portion 13 of the connector housing 10) so as to retain the retainer 50 in the provisionally-retaining position and the completely-retaining position.

The second arm 62 has an L-shaped guide rib 66 for fitting in a guide groove 16 (see FIG. 8) formed in the outer periphery of the main portion 13 of the connector housing 10. The L-shaped guide rib 66 can be fitted in the guide groove 16 so as to slide in the direction of insertion of the retainer 50, thereby preventing the retainer 50 from disengagement from the connector housing 10. The pair of arms 51 of the retainer 50 are so disposed as to prevent the withdrawal of the seal member 90.

Next, the operation will be described.

For assembling the connector, first, the retainer 50 is inserted into the retainer insertion port 20 formed in the side portion of the connector housing 10, and the insertion piece portion 54 is inserted into the retainer insertion hole 24 formed in the main portion 13 of the connector housing 10, and at the same time the pair of upper and lower arms 51 are slid on the outer surface of the main portion 13, thereby engaging the retaining projections 65 of the retainer 50 respectively in the provisionally-retaining recesses 21 formed in the main portion 13.

In this condition, although the lances 67 of the retainer 50 intrude respectively into the terminal receiving chambers 18, the secondary retaining portions 68 have not yet intruded into the respective terminal receiving chambers 18. Therefore, in this condition, each terminal 80 is inserted into the terminal receiving chamber 18 from the terminal insertion portion 15 formed at the rear end thereof. As a result, the lance 67 is pressed and elastically deformed by the terminal 80, thus allowing the insertion of the terminal 80, and when the terminal 80 is further inserted into the predetermined position, the lance 67 is restored from the elastically-deformed condition to become engaged with the first engagement projection 87 of the terminal 80, thereby preventing the rearward movement of the terminal 80.

Then, in this condition, the retainer 50 is further pushed into the connector housing 10, thereby engaging the retaining projections 65 of the retainer 50 respectively in the completely-retaining recesses 22 formed in the main portion 13 of the connector housing 10. As a result, the secondary retaining portions 68 of the retaining 50 intrude respectively into the terminal receiving chambers 18, and are engaged respectively with the secondary engagement projections 88 of the terminals 80, thereby preventing the rearward movement of the terminals 80.

By thus inserting the retainer 50 into the connector housing 10, the plurality of terminals 80 can be positively prevented from being withdrawn from the respective terminal receiving chambers 18, and thus the connector can be completed.

When the retainer 50 is held in the provisionally-retaining position and also during the time when the retainer 50 is moved from the provisionally-retaining position to the completely-retaining position, the L-shaped guide ribs 66 of the retainer 50 are slidably fitted respectively in the guide grooves 16 formed in the main portion 13 of the connector housing 10. Therefore, during the transport of the connector and during the movement of the retainer 50, the retainer 50 can be positively prevented from disengagement from the connector housing 10.

Furthermore, when the retainer 50 is attached to the connector housing 10, the arms 51 of the retainer 50 prevent the withdrawal of the seal member 90, and therefore the seal member 90 is prevented from disengagement from the connector housing 10, for example, during the transport.

Furthermore, in the connector of this embodiment, the lances 67 for primarily retaining the terminals 80 are formed integrally on the retainer 50 for secondarily retaining the terminals 80. Therefore, there is no need to form the lances 67 on the connector housing 10, and therefore the structure of the connector housing 10 can be simplified, and the moldability of the resin-made connector housing 10 can be enhanced.

Furthermore, in the case where the lances were formed integrally on the connector housing, a high-strength resin material such as a glass-containing resin material could not be used for forming the connector housing 10 since the lances need to have elasticity. In this embodiment, however, the lances 67 are separate from the connector housing 10, and therefore a high-strength resin material such as a glass-containing resin material can be used for forming the connector housing 10. With the use of such a resin material, the resin of which the connector housing 10 is molded will not become soft under a high-temperature vibrating condition, so that the ability to hold the terminals 80 will not be lowered, and therefore the vibration resistance of the connector can be enhanced. In the case where the lances were formed integrally on the connector housing, the front holder was often required to be attached to the front side of the terminal receiving chambers because of a molding difficulty. In this embodiment, however, such a front holder does not need to be provided since the lances 67 are formed on the retainer 50, and the number of the component parts can be reduced.

What is claimed is:

1. A connector, comprising:

a connector housing having a terminal receiving chamber into which a terminal is to be inserted; and a retainer which is to be inserted into the connector housing so as to extend across the terminal receiving chamber and that is movable from a provisionally-retaining position where the retainer is provisionally retained and to a completely-retaining position where the retainer is completely retained, the retainer including:

an elastic lance for primarily-retaining that is provided so as to project into an interior of the terminal receiving chamber and that is pressed and elastically deformed by the terminal inserted into the terminal receiving chamber so as to allow the insertion of the terminal and then is restored from elastically-deformed condition to become engaged with the terminal when the terminal is inserted into a predetermined position;

a secondary retaining portion that allows the insertion of the terminal into the terminal receiving chamber when the retainer is disposed in the provisionally-retaining position, and that is engaged with the terminal when the retainer is disposed in the completely-retaining position, wherein the secondary retaining portion and the elastic lance are formed integrally in the retainer, and at least when the retainer is disposed in the provisionally-retaining position, the lance projects into the interior of the terminal receiving chamber, a cantilever-like insertion piece portion formed on the elastic lance for insertion into an interior of the connector housing; and a pair of arms extending from a proximal end portion of the insertion piece portion and further extending in generally parallel spaced relation respectively to upper and lower sides of the insertion piece portion, wherein the pair of arms can slide on an outer surface of the connector housing so as to hold the retainer selectively in the provisionally-retaining position and the completely-retaining position, and each of the pair of arms is divided into a first arm and a second arm, and the first arm includes a retaining portion for retaining the retainer in the provisionally-retaining position and the completely-retaining position, and can be elastically deformed when the retainer is to be retained on the connector housing, and the second arm includes a generally L-shaped guide rib for fitting in a guide groove in the outer surface of the connector housing so as to slide in a direction of insertion of the retainer, and the retainer is prevented from disengagement from the connector housing by the L-shaped guide rib fitted in the guide groove.

2. The connector according to claim 1, wherein the connector housing includes a pillar-like main portion which has the terminal receiving chamber and has an outer periphery on which a fitting peripheral wall of a mating connector can be fitted, and a hood portion which covers the outer periphery of the pillar-like main portion with an annular space formed therebetween so as to cover the fitting peripheral wall of the mating connector, and an annular seal member is mounted on the outer periphery of an end portion of the pillar-like main portion disposed at a rear side in a connector fitting direction, and can seal a gap between the main portion and the fitting peripheral wall of the mating connector fitted on the outer periphery of the main portion, and the pair of arms of the retainer are disposed so as to prevent withdrawal of the seal member.

3. The connector according to claim 1, wherein the connector housing includes a plurality of the terminal receiving chambers arranged in a row, and the retainer includes a plurality of the lances equal in number to the plurality of terminal receiving chambers, and a plurality of the secondary retaining portions equal in number to the plurality of terminal receiving chambers.

* * * * *